US007040047B2

(12) United States Patent
Boulud et al.

(10) Patent No.: US 7,040,047 B2
(45) Date of Patent: May 9, 2006

(54) IRON WITH SELF-CLEANING SOLE PLATE

(75) Inventors: Henry Boulud, Diemoz (FR); Stephanie Pessayre, Ecully (FR); Jean-Louis Compeau, St. Quentin Fallavier (FR); Jean-Claude Bertolini, Villeurbanne (FR)

(73) Assignees: SEB S.A., Ecully (FR); CNRS, Paris Cedex (FR)

( * ) Notice: Subject to any disclaimer, the term of this patent is extended or adjusted under 35 U.S.C. 154(b) by 230 days.

(21) Appl. No.: 10/479,243

(22) PCT Filed: May 24, 2002

(86) PCT No.: PCT/IB02/01945

§ 371 (c)(1),
(2), (4) Date: Dec. 1, 2003

(87) PCT Pub. No.: WO02/097185

PCT Pub. Date: Dec. 5, 2002

(65) Prior Publication Data

US 2004/0172868 A1 Sep. 9, 2004

(30) Foreign Application Priority Data

Jun. 1, 2001 (FR) ..... 01 07209

(51) Int. Cl.
*D06F 75/38* (2006.01)

(52) U.S. Cl. ..... 38/93

(58) Field of Classification Search ..... 38/93, 38/80, 81, 88, 97; 126/19 R; 502/2; 427/453; 428/651

See application file for complete search history.

(56) References Cited

U.S. PATENT DOCUMENTS

| | | | | |
|---|---|---|---|---|
| 3,266,477 | A * | 8/1966 | Stiles | 126/19 R |
| 3,566,855 | A * | 3/1971 | Morgan | 126/19 R |
| 3,993,597 | A * | 11/1976 | Stiles | 502/2 |
| 4,702,933 | A * | 10/1987 | Kramer | 427/453 |
| 4,862,609 | A | 9/1989 | Ullrich et al. | |
| 5,014,454 | A * | 5/1991 | Maurin et al. | 38/93 |
| 6,926,971 | B1 * | 8/2005 | Groll | 428/651 |

FOREIGN PATENT DOCUMENTS

| | | |
|---|---|---|
| EP | 0 510 546 | 10/1992 |

* cited by examiner

*Primary Examiner*—Ismael Izaguirre
(74) *Attorney, Agent, or Firm*—Browdy and Neimark, PLLC

(57) ABSTRACT

The invention relates to an iron comprising a sole plate which forms the ironing surface. An oxidation catalyst, which is active on organic dirt, covers the ironing surface. Said catalyst is active when the soleplate reaches a temperature which is at least equal to or higher than 90° C.

15 Claims, 2 Drawing Sheets

IRON WITH SELF-CLEANING SOLE PLATE

The present invention relates to pressing irons.

Pressing irons have qualities of ease of use and efficiency depending inter alia on the state and the nature of the ironing surface of their soleplate. Soleplates have been able to be improved by the care brought to the sliding qualities of the ironing surface, combined with qualities permitting easier spreading out of the laundry. One manner of obtaining these qualities is to resort to enameled soleplates with an enamel having a smooth appearance, with possibly raised lines permitting spreading of the fabric during displacement of the iron. Other metal soleplates mechanically treated and/or covered or not with a deposit to facilitate sliding can equally be suitable for a satisfactory usage.

However, during use, the soleplate can be tarnished by carbonizing in a more or less diffuse manner on the ironing surface, and in a more or less incomplete manner, various organic particles trapped by rubbing on the fabrics being ironed.

But when the soleplate is tarnished even in a manner that is hardly visible, it partially loses its sliding qualities. Imperceptibly, with the soiling, the ironing becomes more difficult. Moreover, the user becomes apprehensive of using a tarnished iron, fearing that it can alter the laundry.

Pressing iron soleplate coatings are known that have a hard and durable layer covered, as indicated by the patent U.S. Pat. No. 4,862,609, by a layer improving its surface properties. But this patent does not indicate a solution for combating soiling.

The object of the invention described herebelow is a self-cleaning pressing iron, the soleplate of which is maintained clean of any contamination by organic particles and is not clogged by normal usage, in a manner to retain its initial qualities.

The goal of the invention is achieved by a pressing iron having a soleplate, the outer surface of which comprises the ironing surface, characterized in that an oxidation catalyst having an oxidation catalytic agent is present or distributed in and/or on a surface layer of said soleplate, said oxidation catalyst being active with respect to organic dirt at a temperature at least equal to 90° C.

Due to the invention, during ironing, organic particles captured by the soleplate are oxidized. They are to some extent burned when the pressing iron is hot, the possible solid residue loses all adherence and is detached from the soleplate. The soleplate is maintained clean.

In fields very different from ironing, an oxidation catalyst has already been associated with an external surface of a support.

Enameled self-cleaning surfaces are known, for example in ovens and cooking utensils such as described for example in the patent U.S. Pat. No. 4,029,603 or the patent FR 2400876.

The patent U.S. Pat. No. 4,994,430 describes an enameled coating having a dense layer and at the surface a porous layer supporting a catalyst. But such a thick, porous layer is incompatible with ironing.

There is also known from the patent U.S. Pat. No. 5,388,177 a deodorizing heating element, the enameled surface of which is coated with a catalyst, but the catalyst is provided only for deodorizing.

In any case, the solutions described in these documents cannot be applied to a pressing iron, since one could fear in particular that, on the one hand the requirements of low roughness for the ironing surface are opposed to the retention of the oxidation catalyst, and on the other hand the rubbing resulting from the ironing rapidly removes the oxidation catalyst from the external surface of the ironing soleplate.

The oxidation catalyst is distributed on and/or in the surface layer of the iron, where it is in contact with the dirt, or stains.

In practice, the oxidation catalyst is present and/or distributed on the surface over all or part of the outer surface of the soleplate.

Thus, the oxidation catalyst can be present or distributed between predetermined zones of the outer surface of the soleplate, for example in the recessed zones of the outer surface, susceptible to capturing or accumulating dirt and in general hotter than the ironing surface, which is favorable for oxidation or catalytic.

When the outer surface of the soleplate has one or several parts that are recessed with respect to the remaining flat part, forming the useful surface or the ironing surface proper, the oxidation catalyst is present or distributed in the recessed part or parts, to the exclusion of the ironing surface.

But, of course, the oxidation catalyst can be present, over all or part of the ironing surface proper.

The catalytic oxidation agent considered according to the present invention is thus any element, compound or composition capable of oxidizing, at a temperature at least equal to 90° C., any organic substance such as contained in the dirt, or stains, presently encountered in the treatment (including washing and possibly softening) of textile articles or pieces (for example linen).

Such a catalytic oxidation agent can be specific or non-specific for one organic substance or another.

In practice, the oxidation catalyst can have or not, in addition to the catalytic oxidation agent, an inert support, for example in divided or particle form, for example alumina, at the surface (including internally) of which the catalytic oxidation agent is distributed or dispersed. The inert support can itself constitute, in the non-divided state, the surface layer that will be discussed herebelow.

As examples of catalytically active elements, one can cite palladium, platinum, vanadium, copper or any composition of such catalytically active elements (in terms of oxidation). In the active catalytic compositions considered according to the present invention, there can be present oxides of copper, manganese or cobalt, increasing the catalytic effectiveness or the stability of the catalytic agent.

In practice, such oxidation catalysts are well known per se, as well as the processes for obtaining them, without there being a need to describe them by the details of their methods of preparation respectively. Thus, by way of example, in the matter of platinum as a catalytic oxidation agent, its catalytically active form can be obtained by calcination or decomposition of a chloro-platinic acid salt or any other precursor.

Of course, any oxidation catalyst retained according to the present invention should remain sufficiently stable at the working temperature of the ironing surface, and this within the limits of the useful life of the pressing iron.

In practice, the oxidation catalyst according to the invention is found distributed at least in and/or on the surface layer of the soleplate of the pressing iron. By "surface layer", there is intended any limiting layer, of which the thickness can, by way of example, be at least equal to 500 nanometers and particularly comprised between 20 nanometers and 120 nanometers in contact at one side with another layer or the substrate of the soleplate and providing at the other side an interface with the outside, having the ironing surface proper. The oxidation catalyst or the catalytic oxidation agent can be distributed over all or part of the outer surface of the soleplate, in the thickness and/or on the above-cited outer layer, in a continuous or discontinuous manner.

By "ironing surface", there is intended all or the useful part of the outer surface of the soleplate, coming directly in contact with the laundry during ironing.

When the oxidation catalyst remains on the surface layer of the soleplate, it can form a layer or a film that is continuous or discontinuous.

The above-cited surface layer cannot be distinguished from the rest of the soleplate, of its substrate, or of a constituent layer of this latter, in which case, in the present description and in the following claims, use of the term "surface layer" only has the object of distinguishing the limited thickness, possibly zero, of the soleplate, in which the oxidation catalyst or the catalytic oxidation agent can be distributed and incorporated.

The thickness of the surface layer in which the catalyst or catalytic oxidation layer can be comprised depends particularly on the depth of migration of organic dirt into the interior of the soleplate of the pressing iron, starting from the outer surface.

By "organic dirt", there is intended any substance that is combustible or oxidizable on contact with ambient air, completely or partially. By way of example, one can cite any residue of synthetic fibers, such as used in textile articles, for example in organic polymers such as polyamide or polyester or any residue of washing products or possibly of softening products.

By of example, the catalytic oxidation agent comprises a metal of group IV of the periodic table or a noble metal, for example palladium and/or vanadium.

The oxidation catalyst being active at a soleplate temperature greater than or equal to 90° C., it cleans said soleplate when it is hot.

In a first mode of operation, the catalyst acts at the ironing temperature of the iron, and the soleplate is maintained clean permanently to the extent that the iron is used for ironing.

In a second mode of operation, during a phase called self-cleaning, before or after use of the pressing iron, the iron is regulated to an elevated temperature equal to or greater than the highest ironing temperatures. It is then left alone during a predetermined time, during which the oxidation catalyst produces its effect. The user can thus maintain the iron regularly, without awaiting a harmful soiling.

In a first version, the iron has a metal soleplate clad with an enamel having a low porosity and/or roughness at the micrometric and/or nanometric scale, and the oxidation catalyst belongs to the surface layer of the enamel cladding. The enamel is, for example, a vitrified enamel.

Such an enamel is chosen from among the enamels having a low porosity, for example vitrified, known for their ironing qualities, this in comparison with the enamels used in ovens or on grills, which being porous require needlessly the deposit of a substantial quantity of oxidation catalyst and do not have the qualities required for a soleplate of a pressing iron.

The enamel should in effect at least be hard, have good sliding property and resist the penetration of steam or warm moisture.

The attainment or the application of the oxidation catalyst or of the catalytic oxidation agent on or in the above-cited surface layer can be performed by any known means such as by the application of any precursor of the catalytic oxidation agent, then baking by using a pyrolytic process or by electrophoresis or by chemical deposition without current called "electroless" or by vapor deposition.

By "precursor", there is intended any chemical or physico-chemical form of the oxidation catalyst and/or of the catalytic oxidation agent which is capable of ending with or liberating this latter by any appropriate treatment, for example pyrolysis. By way of example, any chloro-platinic acid salt is a precursor for the platinum considered as an oxidation catalyst.

As shown by the examples herebelow, the choice of the composition of the oxidation catalyst or of the catalytic oxidation agent, and/or the condition of obtaining or application of this latter are determined to not substantially alter the intrinsic qualities of the ironing surface, notably its glide.

In a second version, the pressing iron has a metal soleplate, for example an aluminum alloy, and a surface layer is added to the outer surface of said soleplate, in the form of a thin layer of a support, for example alumina, for said agent for catalytic oxidation of said organic dirt.

By way of variation, the soleplate is clad with a layer of a polymer resistant to all oxidation at high temperature, for example polytetrafluoroethylene, and the surface layer belongs to said polymer layer.

In a third version, the surface layer consists of a thin layer of the oxidation catalyst, comprising an inert support, for example alumina, and a catalytic oxidation agent supported by said support.

In a general manner, the invention also concerns the use of an oxidation catalyst as a self-cleaning agent for all or part of the outer surface of the soleplate of a pressing iron.

The invention will be better understood from a reading of the following examples and the attached drawings.

EXAMPLE 1

Figure 1:
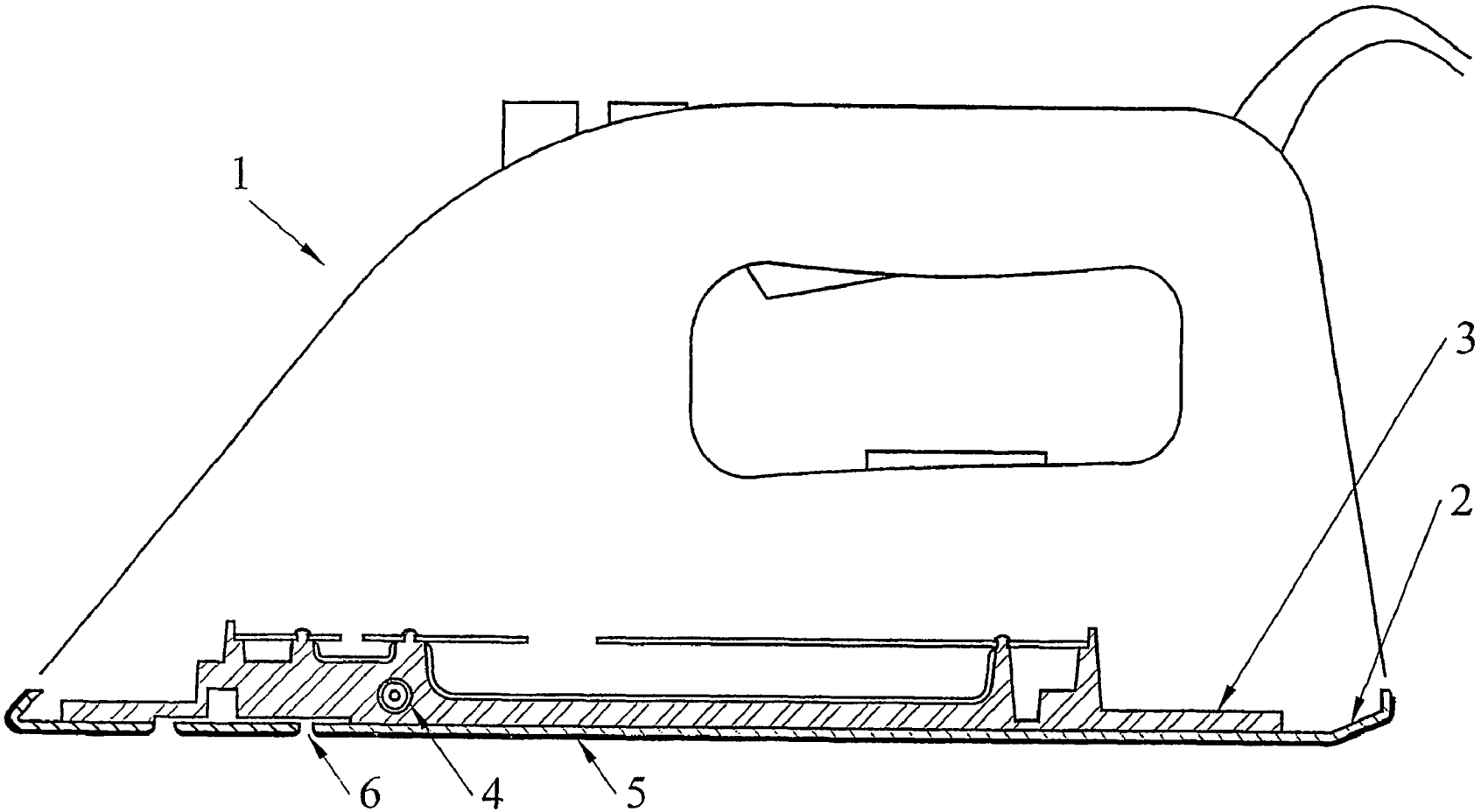
FIG. 1 is a cross-sectional view of a soleplate of a pressing iron according to the invention.
Figure 2:
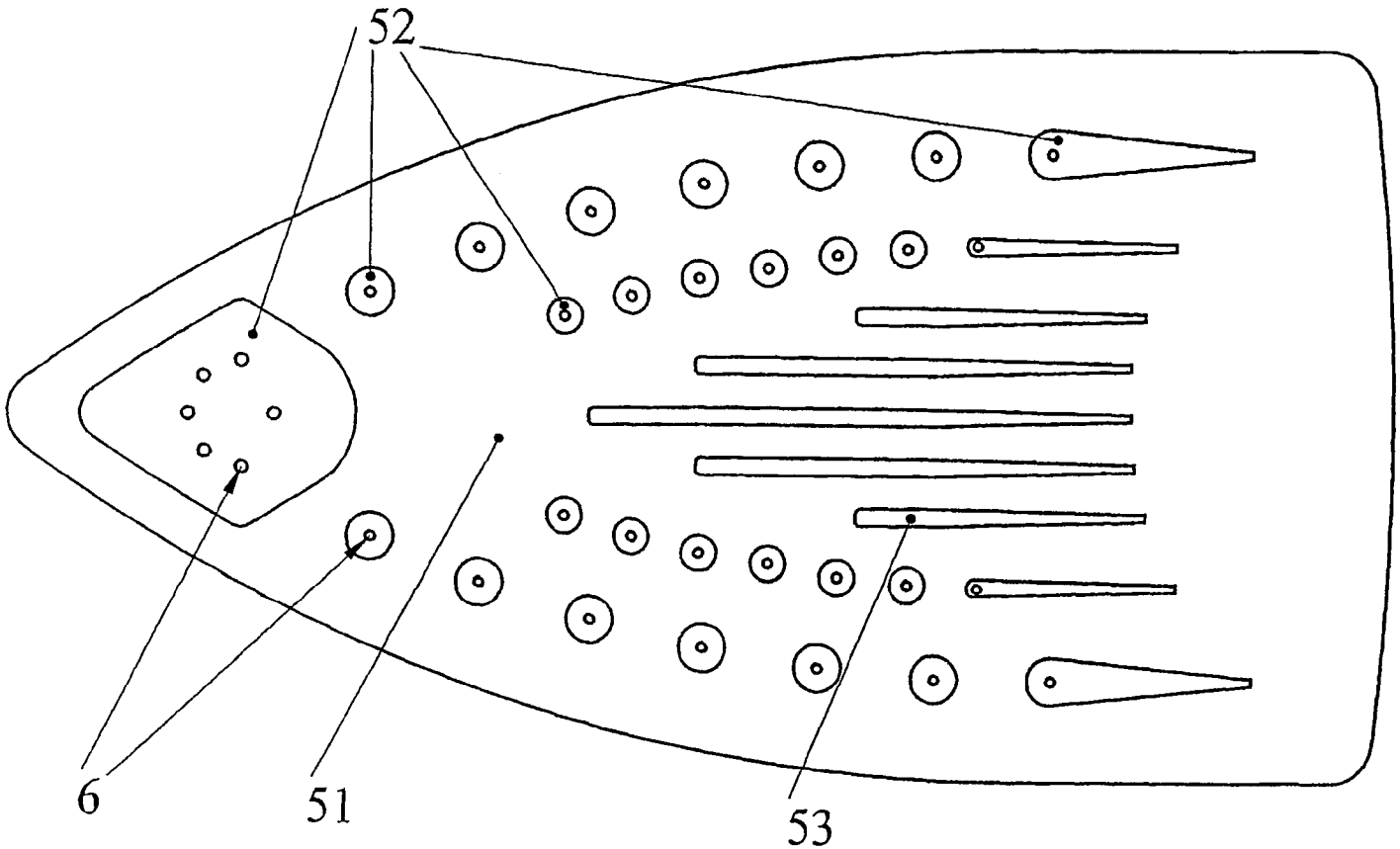
FIG. 2 is a bottom view of a pressing iron according to the invention, showing the lower face of the soleplate.

In a first example of realization, pressing iron 1 visible in FIG. 1 has a soleplate 2 of aluminum fixed to a heating base 3 of molded aluminum and furnished with a heating element 4. Soleplate 2 is coated on its external surface 5 more easily visible in FIG. 2 by an enamel known for its ironing qualities. The catalyst or catalytic oxidation agent is deposited in a very thin layer on the outer surface. This outer surface 5 has the ironing surface 51 proper, and recessed parts 52, 53 for example around steam outlet orifices 6.

For this purpose, the outer surface is degreased and activated by a light acid attack, for example with a citric or nitric acid solution. A precursor of the catalytic oxidation agent is prepared, for example by dissolving palladium nitrate in water at a rate of 2 grams of palladium nitrate per liter. Moreover, several companies, for example the company PCAS of Longjumeau, France, furnish more developed precursors. The soleplate being heated to around 300° C., the precursor is applied in solution on the soleplate by allowing it to pass below an ultrasonic atomizer, in one or several passes, to obtain a good homogeneity of the application. The assembly is baked at around 300° C. The thickness of the layer of oxidation catalyst (palladium) thus obtained can vary from 20 to 120 nanometers. Preferably, the device is regulated to obtain a thickness of the order of 30 nanometers. One notes that the deposit of palladium is adherent to the ironing surface, and does not disturb the glide characteristics of the underlying enamel in a noticeable manner.

The effectiveness of the oxidation catalyst can be measured in a closed enclosure. A sample of the soleplate is heated to 300° C., on which is deposited a piece of fiber, of organic polymer, of 2 mg, melted representative of dirt. After having dosed the initial quantity of carbonic gas into the enclosure, one notes its increase, attesting to the effectiveness of this solution.

In the example thus described, there was obtained a catalytic activity at 300 degrees having permitted production of $107\times10^{-6}$ moles of carbonic gas per hour, for a catalytically surface, sample, of 10 square centimeters.

EXAMPLE 2

In a second example of realization, the enameled soleplate is heated to 300 degrees. A solution comprising alumina in suspension is prepared by mixing 4 grams of tetraethylorthosilicate with 96 grams of nitric acid diluted to 0.6%, to which is added 12.8 grams of "DISPERSAL S". This latter alumina based product is furnished by the company CONDEA. The solution diluted 10 times is sprayed on the soleplate. The soleplate is maintained at 300 degrees during one hour. The spraying is regulated to obtain a deposit in solid form of around 10 micrometers thickness, of a support of catalytic oxidation agent that is alumina based. Then an aqueous solution of palladium nitrate is sprayed, which is subjected to baking at 300 degrees for one hour.

With respect to the preceding example, the activity of a same active catalytic surface, sample, is brought to $175\times10^{-6}$ moles of carbonic gas produced per hour.

EXAMPLE 3

In a third example of realization, the iron has an aluminum soleplate. The ironing surface is cleaned by a sodic attack followed by a neutralization and a rinsing. The soleplate is oxidized in an oven at 560 degrees for 30 minutes, then there is applied by spraying a solution of palladium nitrate at 2 grams per liter. After baking at 300 degrees for one hour, one obtains a catalytically active or oxidation catalyst surface layer of around 30 nanometers thickness.

One obtains glide properties substantially similar to those of aluminum. The value of this realization resides in the economy of fabrication. The activity obtained is of the order of $112\times10^{-6}$ moles of carbonic gas produced per hour, for a catalytically active surface, sample, of 10 square centimeters.

In a variant of this example of realization, the catalytic oxidation agent is incorporated in a surface layer of the Ormosil type, serving as a support, this term being an abbreviation for the English expression "Organically Modified Silicates", as explained in the article "Structures and properties of Ormosils" of the *Journal Sol-Gel Science and Technology,* 2, 81–86, (1994), written by John D. Mackenzie. Preferably, the surface layer is obtained starting from a liquid solution intended to produce a gel.

The catalytic oxidation agent is then deposited on and/or in this surface layer, by a process similar to the preceding utilizing an ultrasonic atomizer. One to four passes permit obtaining a good homogeneity. The assembly is then dried, then baked at around 300° C.

EXAMPLE 4

In a fourth example of realization, the iron has a stainless steel soleplate. The ironing surface is cleaned then passivated in a 20% nitric acid bath. On the ironing surface heated to 300 degrees, there is applied an alumina-based solution such as described in the second realization and the soleplate is maintained at 300 degrees for one hour in order to obtain a surface layer serving as a support for the catalytic oxidation agent. A catalytic oxidation agent layer is then deposited in and on this surface layer, by spraying with an ultrasonic atomizer a solution of palladium nitrate. The assembly is then dried then baked at around 300° C. There is measured an effectiveness at 300 degrees of $151\times10^{-6}$ moles of carbonic gas produced per hour, for a catalytically active surface, sample, of 10 square centimeters.

In a practical manner, one notes a substantial difference of soiling between two irons, only one of which is provided with a self cleaning soleplate according to the invention.

It is also noted that when a soiling is thick, it is consumed in the zone of contact of the oxidation catalyst, then separates from the soleplate. Self-cleaning is obtained without awaiting complete transformation of the dirt.

Although the activity of the oxidation catalyst is manifested at the low temperatures of ironing, however greater than 90° C., this activity is much greater at higher temperatures. The user uses the pressing iron in the usual manner. After an ironing session, if there is need, she acts on a cleaning control button. This control modifies the assigned temperature of the iron, to bring it to a temperature recommended for functioning of the oxidation catalyst, and marks the start of a predetermined self-cleaning phase, during which this temperature is maintained, and beyond which the heating of the iron halts automatically. During this phase, the oxidation catalyst exerts its full effect. Dirt that can be adhered to the soleplate is consumed without danger, this including in the zones of recesses 52, 53, after which the iron recovers all of its initial properties.

The invention claimed is:

1. Pressing iron having a soleplate, the outer surface of which comprises the ironing surface, characterized in that an oxidation catalyst having an oxidation catalytic agent is present or distributed in and/or on a surface layer of said soleplate, said oxidation catalyst being active with respect to organic dirt at a temperature at least equal to 90° C.

2. Pressing iron according to claim 1, characterized in that the soleplate is of metal and clad with a layer of enamel having a low porosity, and the surface layer is part of said layer of enamel.

3. Pressing iron according to claim 2, characterized in that the enamel is vitrified.

4. Pressing iron according to claim 1, characterized in that the soleplate is clad with a layer of a polymer resistant to all oxidation at high temperature, and the surface layer is part of said layer of polymer.

5. Pressing iron according to claim 4, characterized in that the polymer is polytetrafluoroethylene.

6. Pressing iron according to claim 1, characterized in that the soleplate is of metal, and the surface layer is added to the outer surface of said soleplate, in the form of a thin layer of a support for said agent for catalytic oxidation of said organic dirt.

7. Pressing iron according to claim 6, characterized in that the support is made of alumina.

8. Pressing iron according to claim 1, characterized in that the catalytic oxidation agent comprises a metal of group IV of the periodic table or a noble metal.

9. Pressing iron according to claim 8, characterized in that the metal of the catalytic oxidation agent consists of at least one of palladium and vanadium.

10. Pressing iron according to claim 1 characterized in that the surface layer consists of a thin layer of the oxidation catalyst, comprising an inert support, and a catalytic oxidation agent supported by said support.

11. Pressing iron according to claim 10, characterized in that the support is made of alumina.

12. Pressing iron according to claim 1, according to which the outer surface has at least one part that is recessed with respect to the remaining flat part, forming the useful or ironing surface, characterized in that the oxidation catalyst is present or distributed in said recessed part, to the exclusion of the ironing surface.

13. Pressing iron according to claim 1, characterized in that the oxidation catalyst is present and distributed between predetermined zones of the outer surface of the soleplate, susceptible to capturing or accumulating said dirt.

14. Pressing iron according to claim 13, characterized in that the predetermined zones of the outer surface of the soleplate are recessed zones of the outer surface.

15. A method for inparting a self-cleaning property to at least part of the outer surface of the soleplate of a pressing iron, comprising providing the outer surface of the soleplate with an oxidation catalyst as a self-cleaning agent.

* * * * *